US012082666B2

(12) United States Patent
Luo

(10) Patent No.: US 12,082,666 B2
(45) Date of Patent: Sep. 10, 2024

(54) ROTATION MECHANISM FOR AN UMBRELLA AND AN UMBRELLA THEREOF

(71) Applicant: Phaeton Manufacturing LLC, Nantong (CN)

(72) Inventor: Xiong Luo, Nantong (CN)

(73) Assignee: Phaeton Manufacturing LLC, Nantong (CN)

( * ) Notice: Subject to any disclaimer, the term of this patent is extended or adjusted under 35 U.S.C. 154(b) by 57 days.

(21) Appl. No.: 17/454,874

(22) Filed: Nov. 15, 2021

(65) Prior Publication Data

US 2022/0248819 A1 Aug. 11, 2022

(30) Foreign Application Priority Data

Sep. 26, 2021 (CN) ..... 202111139189.9

(51) Int. Cl.
*A45B 25/14* (2006.01)

(52) U.S. Cl.
CPC ..... *A45B 25/14* (2013.01); *A45B 2025/146* (2013.01); *A45B 2200/10* (2013.01)

(58) Field of Classification Search
CPC ..... A45B 25/14; A45B 2025/146
See application file for complete search history.

(56) References Cited

U.S. PATENT DOCUMENTS 2,409,009 A * 10/1946 Bakke ..... F16D 41/12 192/46
2,914,154 A * 11/1959 Russell ..... A45B 25/14 192/15
4,386,621 A * 6/1983 Redl ..... A45B 25/14 242/603
5,711,333 A * 1/1998 Vanderminden, Sr. ..... A45B 17/00 135/20.1
6,182,917 B1 * 2/2001 Lai ..... A45B 25/14 242/395
6,230,724 B1 * 5/2001 Lai ..... A45B 25/14 242/395
6,591,848 B2 * 7/2003 Ma ..... A45B 25/14 135/22

* cited by examiner

*Primary Examiner* — Noah Chandler Hawk
(74) *Attorney, Agent, or Firm* — Wang Law Firm, Inc.

(57) ABSTRACT

A rotation mechanism for an umbrella comprises a vertical columnar (1), a rotating shaft (2), a ratchet (3) having a plurality of ratchet teeth (30), a magnet block (4) a pressing assembly (5), a limiting room (10); wherein the magnet block (4) is movably located inside the limiting room (10); when the ratchet (3) rotates in a first direction, the magnet block (4) departs from the ratchet teeth (30); when the ratchet (3) rotates in a second direction, the magnet block (4) is attached and magnetically attracted to the ratchet teeth (30); the pressing assembly (5) is connected to the rotating shaft (2) and presses against the two side surfaces of the ratchet (3). The present application also discloses an umbrella comprises the rotation mechanism. The structure is simple and it is easy to assemble.

10 Claims, 7 Drawing Sheets

ROTATION MECHANISM FOR AN UMBRELLA AND AN UMBRELLA THEREOF

TECHNICAL FIELD OF THE INVENTION

The present invention relates to the technical field of umbrellas, and in particular to a rotation mechanism for an umbrella, and an umbrella.

BACKGROUND OF THE INVENTION

As a kind of outdoor leisure items, umbrellas are widely applied in squares, beaches, parks, gardens or similar places to shield an individual from sun. Generally, umbrellas comprise center-support umbrellas and side-support umbrellas. Center-support umbrellas are popular with people due to their convenience in usage, storage and transportation. The demands for such center-support umbrellas are increasing.

Canopies of the existing umbrellas mostly can be folded or unfolded as required. To facilitate the folding or unfolding of canopies of umbrellas and avoid the unexpected folding of canopies, a Chinese patent application CN101669706A, titled CLAMP-TYPE CRANK DEVICE FOR UMBRELLA, disclosed a clamp-type crank device for an umbrella, comprising a crank, a rope rolling shaft, a housing, an upper center rod, a shaft sleeve, a gasket, a spring, a clamp pin, a rivet, a tumbler device and a lower center rod, wherein a pushing protrusion is disposed on the crank and plays a role of clamping the rope; a groove fitted with the pushing protrusion on the crank is disposed on the housing; and, the pushing protrusion on the crank is clamped into or separated from the groove on the housing to control the rotation of the rope rolling shaft so as to roll or unroll and position the rope.

For another example, a Chinese patent application CN101669707A, titled AUTOMATIC CLUTCH CRANK DEVICE, disclosed an automatic clutch crank device, comprising a crank, a housing, a shaft sleeve, a gasket, a spring, a clamp pin, an upper center rod, a lower center rod and a tumbler device, wherein a rope rolling shaft is disposed on the crank; a toothed disc is disposed on the crank; and a toothed disc capable of being meshed with the toothed disc on the crank is also disposed on a retaining surface of the housing. By the elastic force of the spring, the toothed disc on the crank is automatically engaged with or disengaged from the toothed disc on the housing to control of the rotation of the rope rolling shaft so as to roll or unroll and position the rope.

In the prior art, the rotation mechanism for controlling the folding or unfolding of the canopy has many components, complex assembly and high noise when in use. Meanwhile, the existing center-support umbrellas mostly do not have the 360° canopy rotation function but some umbrellas with the 360° canopy rotation function are inconvenient to use, so customers have low overall experience on products.

SUMMARY OF THE INVENTION

It is a first object of the present invention to provide a rotation mechanism for an umbrella, which has simple structure, is easy to assemble, and can roll or unroll a rope stably.

It is a second object of the present invention to provide an umbrella with the rotation mechanism described above.

For achieving the first object, the rotation mechanism for an umbrella comprises:

a vertical columnar having a through hole distributing transversely;

a rotating shaft having a peripheral wall for a rope to roll on, rotatably disposed inside the through hole of the columnar;

wherein, a ratchet is sleeved around the rotating shaft; the ratchet has two side surfaces and a plurality of ratchet teeth on a periphery of the ratchet, one side surface of the ratchet faces a periphery of the rotating shaft;

the columnar has a limiting room facing the ratchet teeth for receiving the magnet block;

the rotation mechanism further comprises:

a magnet block movably located inside the limiting room, and has a magnetic attraction surface capable of being attached to the ratchet teeth; when the ratchet rotates in a first direction, the magnet block departs from the ratchet teeth; when the ratchet rotates in a second direction, the magnet block is attached and magnetically attracted to the ratchet teeth, so as to limit the rotation of the ratchet in the second direction;

a pressing assembly connected to the rotating shaft and presses against the two side surfaces of the ratchet, so as to allow the ratchet rotating with the rotating shaft when the rotating shaft rotates in the first direction, and stop the ratchet from rotating under the action of the magnet block when the rotating shaft rotates in the second direction.

Preferably, the limiting room has an opening toward the ratchet, and the magnet block is placed between the wall of the limiting room and the ratchet teeth of the ratchet.

Preferably, the rotating shaft has a first end and a second end, both ends extending out of the columnar; the rotating mechanism further comprises a handle for rotating the rotating shaft, the handle is disposed outside of the columnar and connected to the first end of the rotating shaft; and the ratchet and the pressing assembly are disposed on the second end of the rotating shaft. The rotating shaft in the present application can also be driven by a motor in addition to the handle.

Preferably, the second end of the rotating shaft has an external thread on the second end of the rotating shaft, and has an opening extending axially from the second end of the rotating shaft and running straightly through the periphery of the rotating shaft; the pressing assembly comprises a nut, a first gasket and a second gasket, the first gasket and the second gasket are sleeved around the second end of the rotating shaft and respectively disposed opposite to two end faces of the ratchet; a first traverse rod and a second transverse rod both capable of being inserted into the opening are respectively disposed on the first gasket and the second gasket; and the nut adjacent to the second end of the rotating shaft is threaded onto the rotating shaft, so that the ratchet is pressed between the first gasket and the second gasket.

In the above solutions, preferably, the columnar is an upper bearing seat, and the rotating shaft is disposed in an upper portion of the upper bearing seat; the rotating mechanism further comprises a lower bearing seat rotatably sleeved around a lower portion of the upper bearing seat, a bearing restrained between the upper bearing seat and lower bearing seat, and a limiting sleeve sleeved around the lower bearing seat and capable of moving up and down due to an external force; an inner circumferential wall of the limiting sleeve and a peripheral wall of the lower bearing seat are meshed with each other through a first tooth portion and a second tooth portion that are disposed circumferentially, and the first tooth portion and the second tooth portion are separated from each other after the limiting sleeve moves down; and the limiting sleeve is partially sleeved around the upper bearing sleeve, two perforations for allowing the two ends of the rotating shaft to extend out are disposed on the wall of the limiting sleeve, and the perforations extend in an up-down direction.

Preferably, the rotation mechanism further comprises a spring sleeved around the upper portion of the upper bearing seat and located between the outer circumferential wall of the upper bearing seat and the inner circumferential wall of the limiting sleeve; a step surface capable of being supported onto the upper end face of the spring is disposed on the inner circumferential wall of the limiting sleeve, and the spring allows the limiting sleeve to always have an upward movement trend.

Preferably, the rotation mechanism further comprises a housing covering the upper bearing seat and the lower bearing seat, the handle is located outside the housing, and the upper portion of the limiting sleeve is exposed above the housing.

For achieving the second object, the umbrella with the rotation mechanism described above comprises an upper support rod and a lower support rod disposed vertically, the bottom of the upper support rod is inserted into the upper bearing seat from the top down and connected to the upper bearing seat, and the lower support rod is inserted with the lower bearing seat. Thus, the upper support rod can rotate relative to the lower support rod, so that the angle adjustment of the canopy connected to the upper support rod can be realized.

Preferably, the lower portion of the lower bearing seat is a cylindrical body and has an outer diameter gradually decreases from the top down; the umbrella further comprises a connecting bushing sleeved around the cylindrical body, the inner diameter of the connecting bushing gradually decreases from the top down and is matched with the outer diameter of the cylindrical body; and the upper portion of the lower support rod is sleeved around the connecting bushing.

Preferably, the umbrella further comprises a spring piece and a buckle; the spring piece is in an inverted V-shape, and one end of the spring piece rests against the inner circumferential wall of the cylindrical body, and the other end thereof is connected to the buckle; and a plurality of holes for allowing the buckle to pass therethrough are disposed on the circumferential walls of the cylindrical body, the connecting bushing and the lower support rod.

Compared with the prior art, the present invention has the following advantages. By additionally providing a ratchet, a magnet block and a pressing assembly on the basis of the columnar and the rotating shaft, and by providing a limiting room at a position on the columnar opposite to the ratchet teeth, the magnet block is movably located inside the limiting room, so that the magnet block is attached and magnetically attracted to the ratchet teeth to limit the further rotation of the ratchet when the ratchet rotates in the second direction and departs from the ratchet teeth when the ratchet rotates in the first direction. Thus, in the present application, the ratchet can be controlled to rotate only in the first direction by providing one magnet block, so that the structure is simple and it is easy to assemble. Meanwhile, since a pressing assembly for providing a pressing force in the axial direction of the ratchet is provided in the present application, the pressing assembly on the rotating shaft can drive the ratchet to rotate synchronously when the rotating shaft rotates in the first direction, and the ratchet cannot rotate with the rotating shaft since the ratchet is resisted by the magnet block when the rotating shaft rotates in the second direction, so that only the rotating shaft rotates in the second direction, and the rope is rolled or unrolled. After the rope is rolled, the ratchet cannot rotate reversely under the resisting action of the magnet block, so that the rope is kept in the rolled state. Therefore, the present invention has the advantage of stable structure.

DETAILED DESCRIPTION OF THE INVENTION

Figure 1:
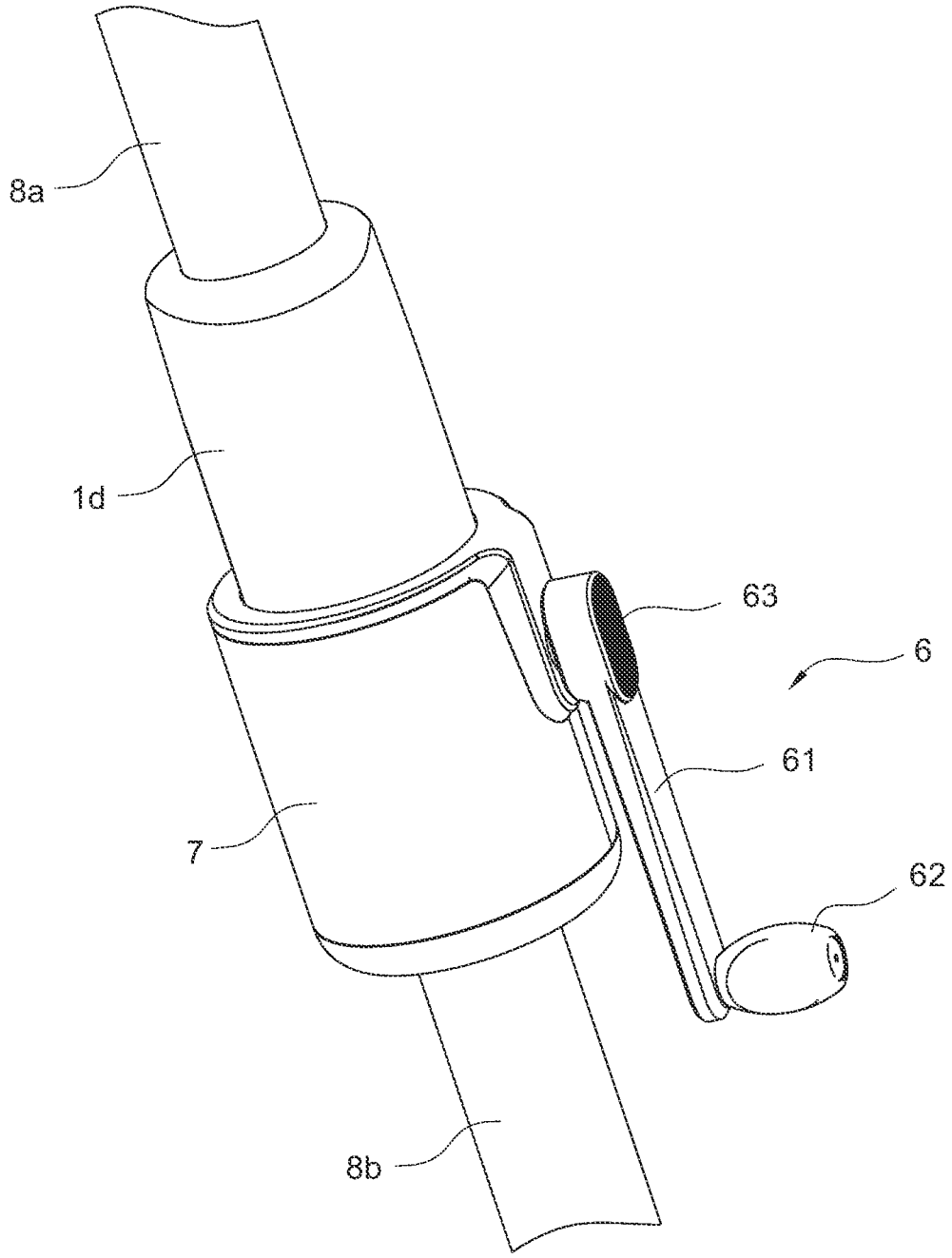
FIG. 1 is a perspective view of an umbrella according to an embodiment of the present invention.

The present invention will be further described in detail below by embodiments with reference to the accompanying drawings.

FIGS. 1-7 show a preferred embodiment of an umbrella with a rotation mechanism of the present invention. The umbrella comprises a rotation mechanism, an upper support rod 8*a*, a lower support rod 8*b*, a spring piece 91 and a buckle 92.

The rotation mechanism comprises a vertical columnar 1, a rotating shaft 2, a ratchet 3, a magnet block 4, a pressing assembly 5, a handle 6, a lower bearing seat 1*b*, a bearing 1*c*, a limiting sleeve 1*d*, a spring 1*e* and a connecting bushing 1*f*.

The vertical columnar 1 is hollow, and has a through hole distributing transversely.

The rotating shaft 2 has a peripheral wall for a rope to roll on, and is rotatably disposed inside the through hole of the columnar 1. In this embodiment, the rope is rolled on the peripheral wall of the rotating shaft 2 inside the columnar 1. The rotating shaft 2 has a first end and a second end, both ends extending out of the columnar 1. In this embodiment, the second end of the rotating shaft 2 has an external thread 21 on the second end of the rotating shaft 2, and has an opening 20 extending axially from the second end of the rotating shaft 2 and running straightly through the periphery of the rotating shaft 2. The first end of the rotating shaft 2 is connected to the handle 6 for driving the rotating shaft 2 to rotate. In this embodiment, the handle 6 comprises a rocker 61 and a rocker head 62 disposed perpendicular to the rotating shaft 2. One end of the rocker 61 is connected to the first end of the rotating shaft 2, while a plurality of CD stripes 63 are disposed at the end of the rocker 61. The rocker head 62 is connected to the other end of the rocker 61 through a shoulder screw 64. Specifically, a rod portion of the shoulder screw 64 passes through the rocker head 62 to be connected to the threads at the other end of the rocker 61. A rocker head blanking cap 65 for shielding the head of the shoulder screw 64 is disposed on the rocker head 62. The details refer to FIGS. 1, 2, 5 and 7.

Figure 2:
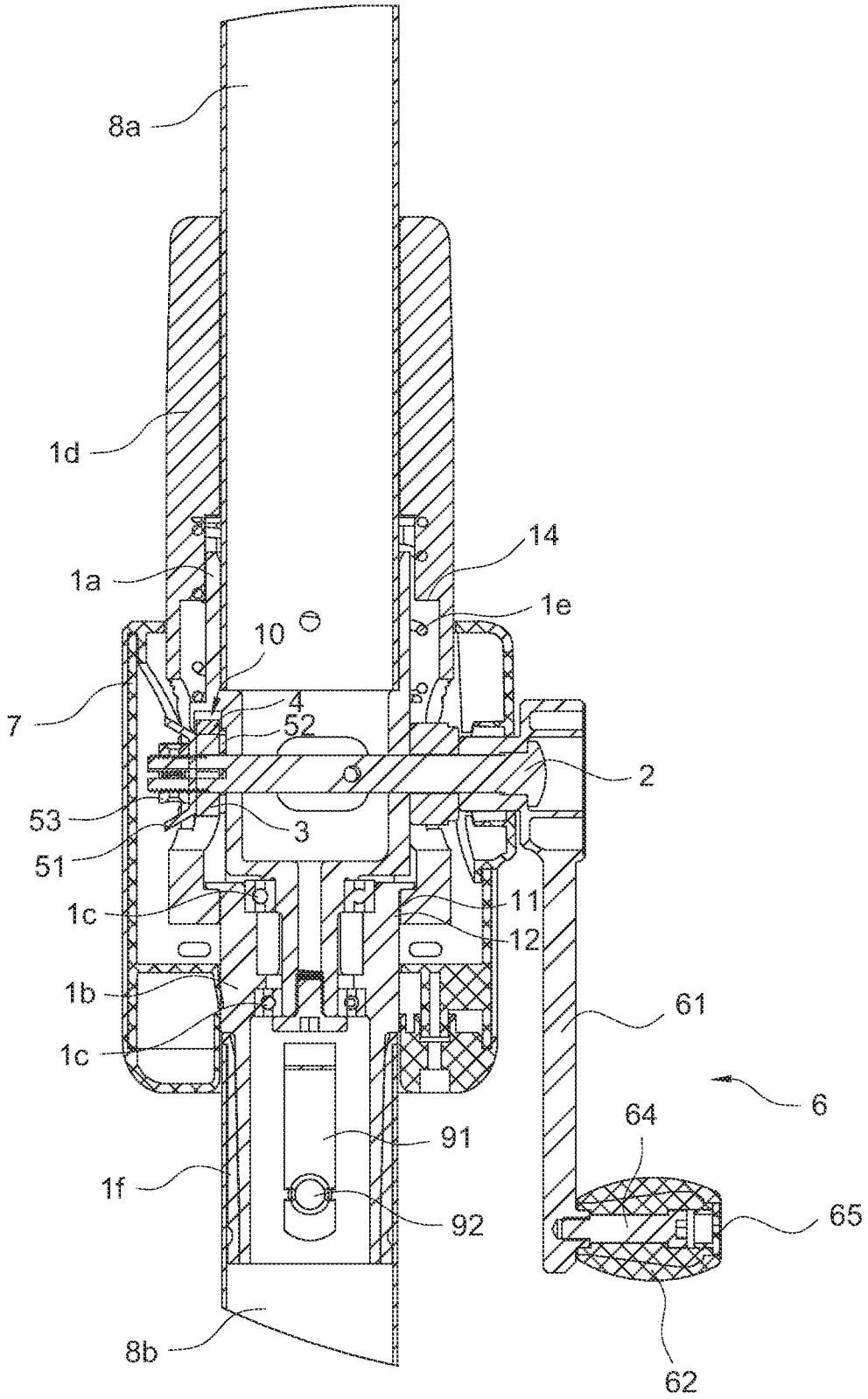
FIG. 2 is a vertical sectional view of FIG. 1.
Figure 3:
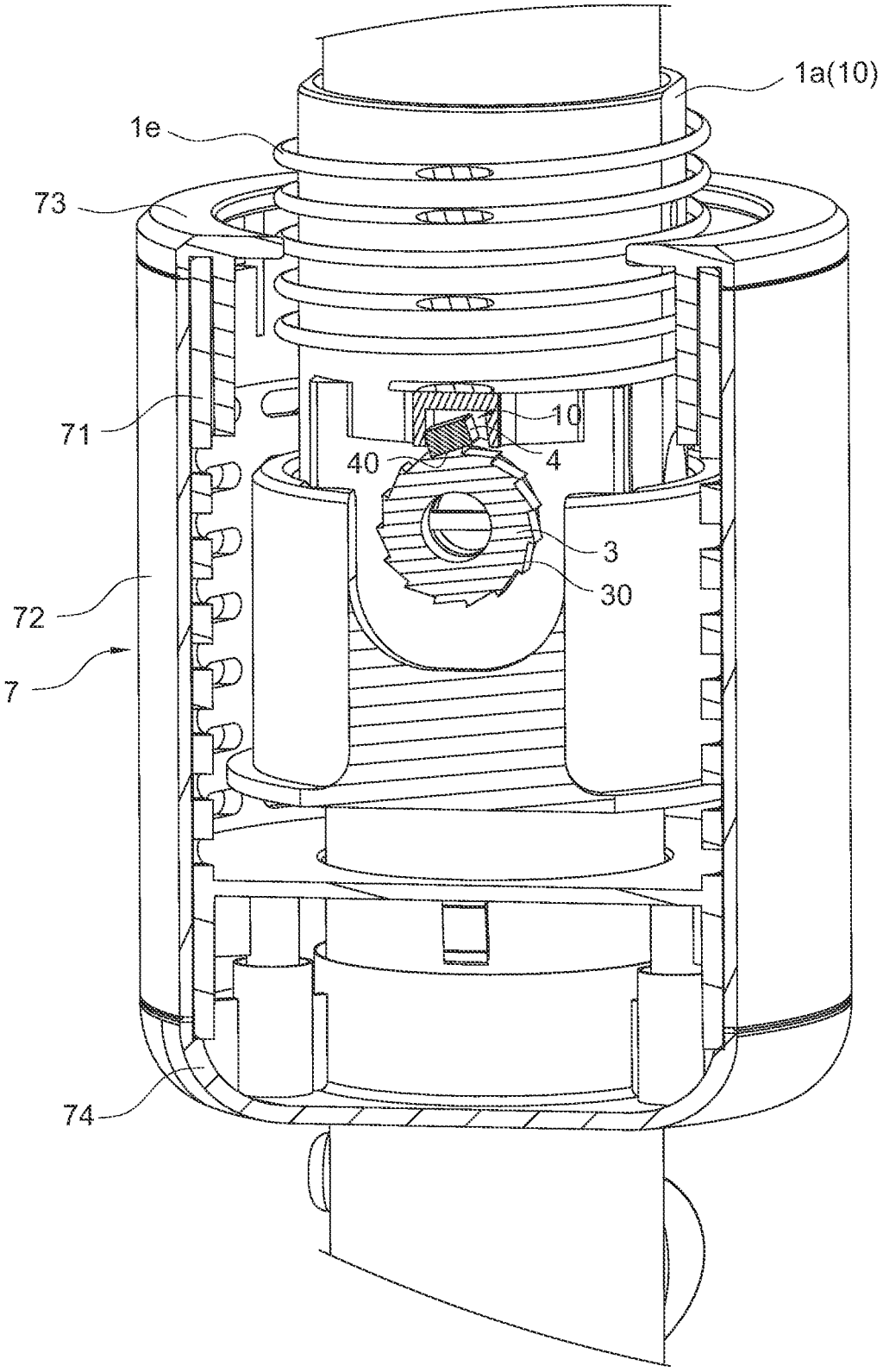
FIG. 3 is a perspective view of FIG. 1 parts of the housing and the upper bearing seat are cutting off.
Figure 4:
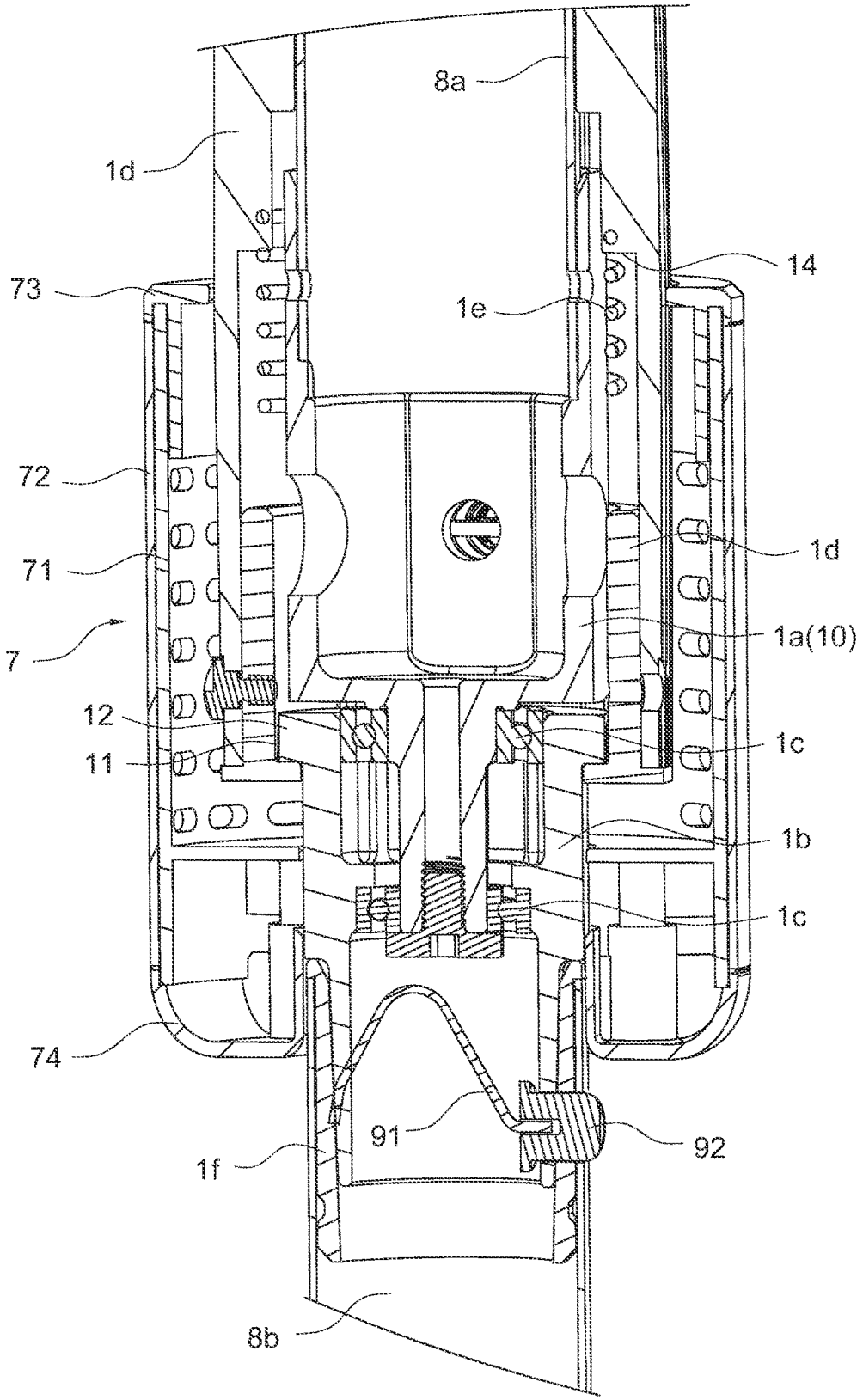
FIG. 4 is another sectional view of FIG. 1.
Figure 5:
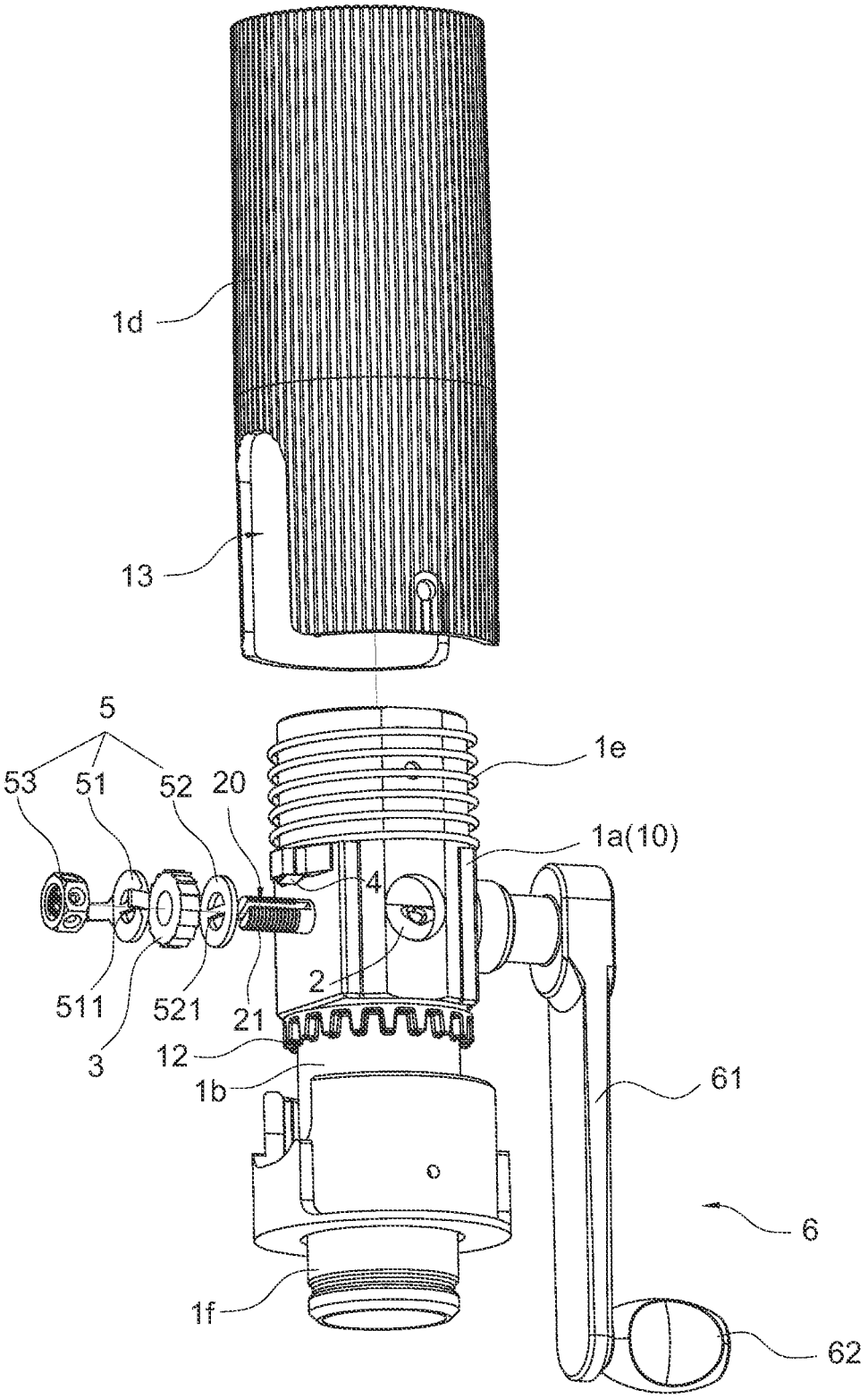
FIG. 5 is a partially exploded view of a rotation mechanism according to the embodiment of the present invention (the housing is omitted)
Figure 6:
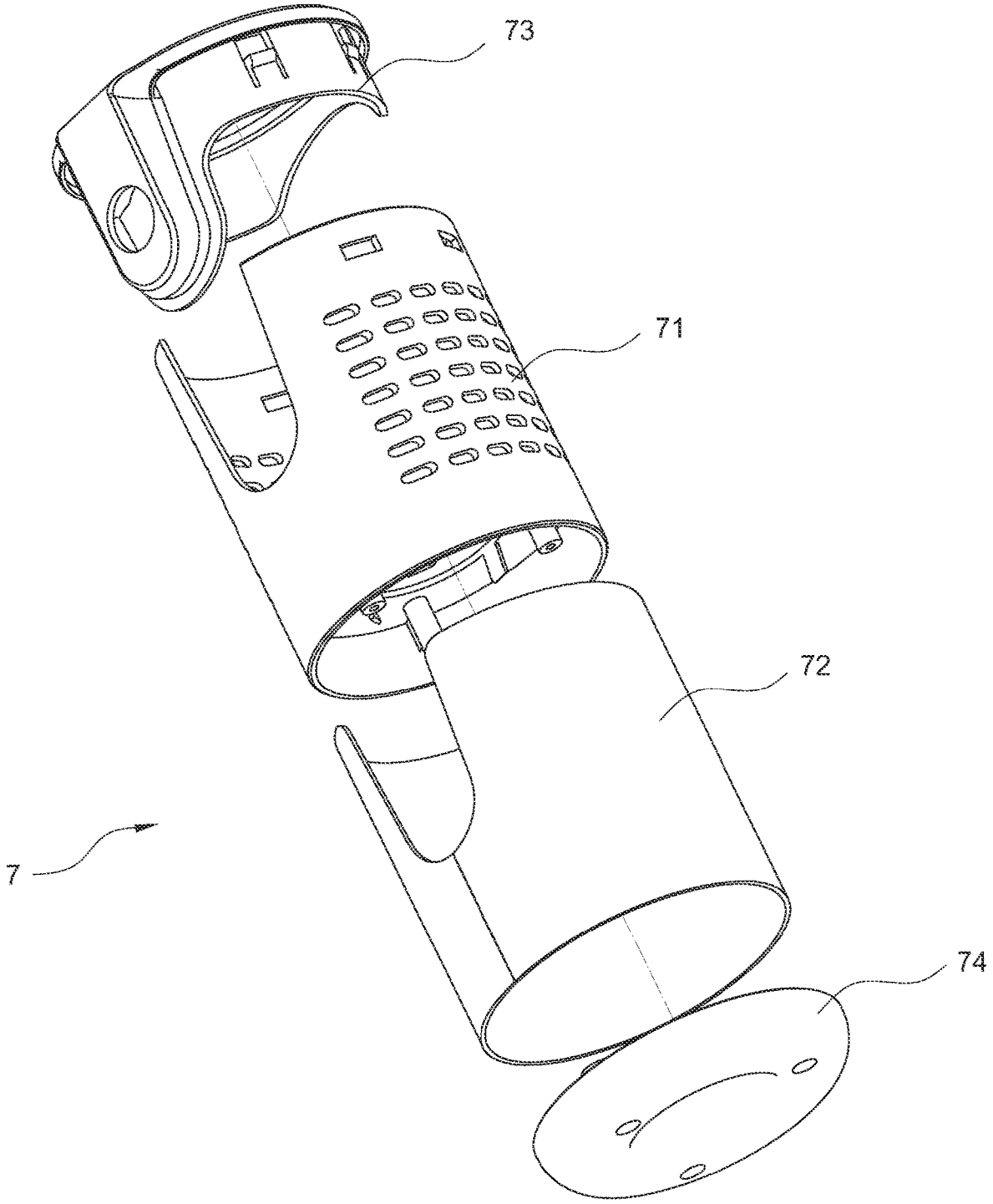
FIG. 6 is an exploded view of the housing according to the embodiment of the present invention.
Figure 7:
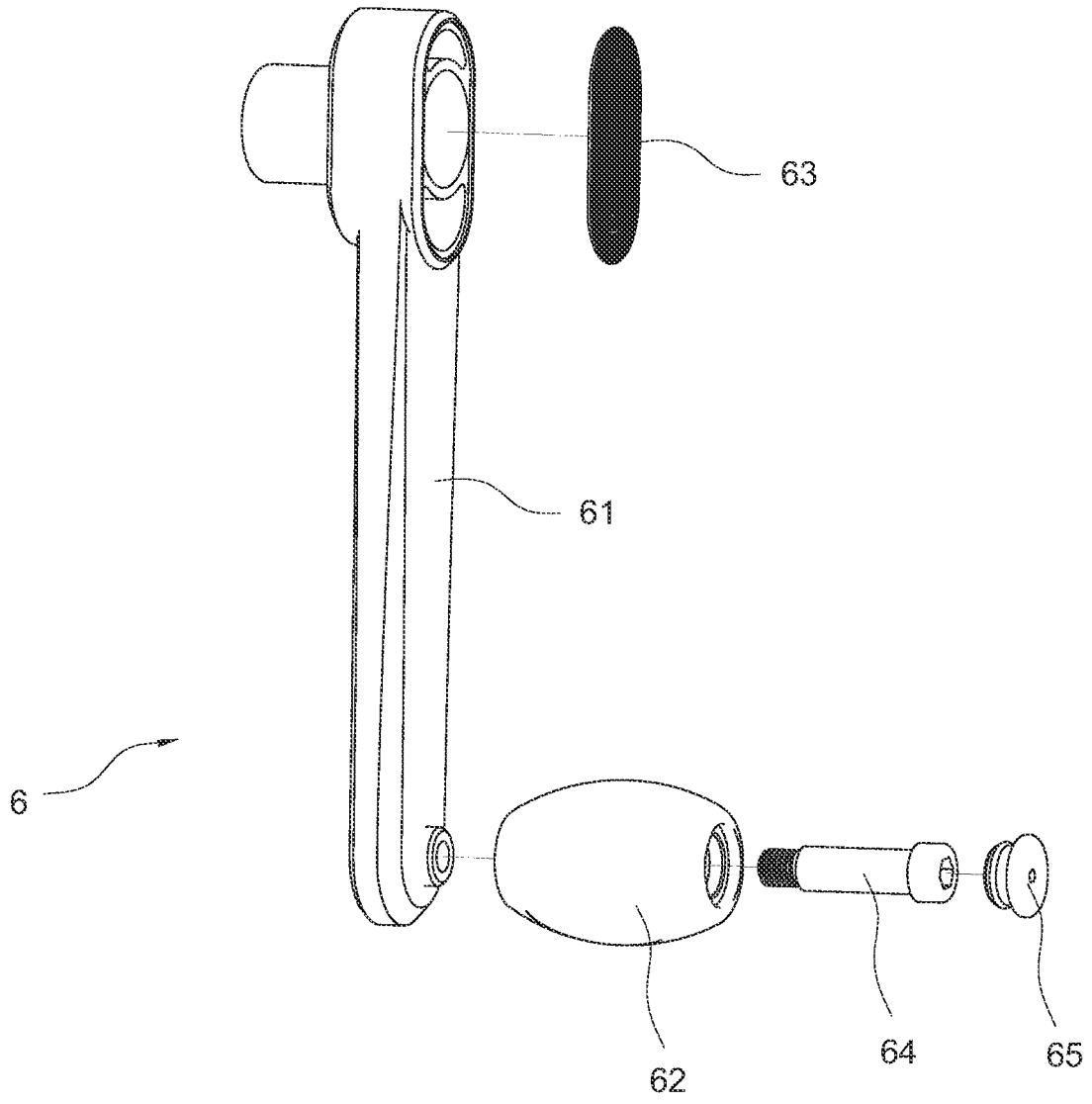
FIG. 7 is an exploded view of the handle according to the embodiment of the present invention.

As shown in FIGS. 2 and 3, the ratchet 3 is sleeved around the second end of the rotating shaft 2, and the ratchet 3 has two side surfaces and a plurality of ratchet teeth 30 on a periphery of the ratchet 3, one side surface of the ratchet 3 faces a periphery of the rotating shaft 2; the columnar 1 has a limiting room 10 facing the ratchet teeth 30 for receiving the magnet block 4. The limiting room 10 has an opening toward the ratchet 3.

The magnet block 4 is movably placed between the wall of the limiting room 10 and the ratchet teeth 30 of the ratchet 3. The magnet block 4 has a magnetic attraction surface 40 capable of being attached to the ratchet teeth 4. When the ratchet 3 rotates in a first anticlockwise direction, the magnet block 4 departs from the ratchet teeth 30; when the ratchet 3 rotates in a second clockwise direction, the magnet block 4 is attached and magnetically attracted to the ratchet teeth 30, so as to limit the rotation of the ratchet 3 in the second direction.

The pressing assembly 5 is connected to the rotating shaft 2 and presses against the two side surfaces of the ratchet 3 along an axis of the ratchet 3, so as to allow the ratchet 3 rotating with the rotating shaft 2 when the rotating shaft 2 rotates in the first direction, and stop the ratchet 3 from rotating under the action of the magnet block 4 when the rotating shaft 2 rotates in the second direction. In this embodiment, the pressing assembly 5 is disposed on the second end of the rotating shaft 2. The pressing assembly 5 comprises a nut 53, a first gasket 51 and a second gasket 52, the first gasket 51 and the second gasket 52 are sleeved around the second end of the rotating shaft 2 and respectively disposed opposite to two end faces of the ratchet 3; a first traverse rod 511 and a second transverse rod 521 both capable of being inserted into the opening 20 are respectively disposed on the first gasket 51 and the second gasket 52; and the nut 53 adjacent to the second end of the rotating shaft 2 is threaded onto the rotating shaft 2, so that the ratchet 3 is pressed between the first gasket 51 and the second gasket 52.

Meanwhile, the columnar 1 in this embodiment is an upper bearing seat 1*a*, and the rotating shaft 2 is disposed in an upper portion of the upper bearing seat 1*a*. The lower bearing seat 1*b* is rotatably sleeved around a lower portion of the upper bearing seat 1*a*. The bearing 1*c* is restrained between the upper and lower bearing seats. A lower portion of the limiting sleeve 1*d* is sleeved around the lower bearing seat 1*b* and can move up and down due to an external force. A first tooth portion 11 disposed circumferentially is arranged on the inner circumferential wall of the lower portion of the limiting sleeve 1*d*, and a second tooth portion 12 disposed circumferentially is arranged on the outer circumferential wall of the lower bearing seat *b*. The limiting sleeve 1*d* and the lower bearing seat 1*b* are meshed with each other through the first tooth portion 11 and the second tooth portion 12, and the first tooth portion 11 and the second tooth portion 12 are separated from each other after the limiting sleeve 1*d* moves down. The upper portion of the limiting sleeve 1*d* is sleeved around the upper bearing seat 1*a*, two perforations 13 for allowing two ends of the rotating shaft 2 to extend out are disposed on the wall of the limiting sleeve 1*d*, and the perforations 13 extend in an up-down direction. The spring 1*e* is sleeved around the upper portion of the upper bearing seat 1*a* and located between the outer circumferential wall of the upper bearing seat 1*a* and the inner circumferential wall of the limiting sleeve 1*d*. A step surface 14 capable of being supported onto the upper end face of the spring 1*e* is disposed on the inner circumferential wall of the limiting sleeve 1*d*, and the spring 1*e* allows the limiting sleeve 1*d* to always have an upward movement trend. Meanwhile, in this embodiment, the lower portion of the lower bearing seat 1*b* is a cylindrical body and has an outer diameter gradually decreases from the top down. The connecting bushing if is sleeved around the cylindrical body, and the inner diameter of the connecting bushing if gradually decreases from the top down and is matched with the outer diameter of the cylindrical body.

The housing 1 covers the upper bearing seat 1*a*, the lower bearing seat 1*b* and the limiting sleeve 1*d*, the handle 6 is located outside the housing 7, and the upper portion of the limiting sleeve 1*d* is exposed above the housing 7. In this embodiment, the housing 7 comprises an inner housing 71, an outer housing 71, a housing upper cover 73 and a housing lower cover 74. The inner housing 71 and the outer housing 72 are cylindrical, and are sleeved with each other and then sleeved around the upper bearing seat 1*a*, the lower bearing seat 1*b* and the limiting sleeve 1*d*. The housing upper cover 73 is sleeved around the limiting sleeve 1*d* and covered at an upper port of the outer housing 72, and the housing upper cover 73 is buckled with the inner housing 71. The housing lower cover 74 is disposed at a lower port of the outer housing 72, and the housing lower cover 74 is connected to the inner housing 71. Two ends of the outer housing 72 are restrained between the housing upper cover 73 and the housing lower cover 74, respectively. The details refer to FIGS. 2, 3, 4 and 6.

The bottom of the upper support rod 8*a* is inserted into the upper bearing seat 1*a* from the top down and connected to the upper bearing seat 1*a*, and the lower support rod 8*b* is inserted with the lower bearing seat 1*b*. Specifically, the upper portion of the lower support rod 8*b* is sleeved around the connecting bushing 1*f*. The spring piece 91 is in an inverted V-shape, and one end of the spring piece 91 rests against the inner circumferential wall of the cylindrical body, and the other end thereof is connected to the buckle 92. A plurality of holes for allowing the buckle 92 to pass therethrough are disposed on the circumferential walls of the cylindrical body, the connecting bushing 1*f* and the lower support rod 8*b*.

When it is need to roll or unroll the rope, the rolling or unrolling of the rope can be realized by rotating the handle 6.

When it is need to rotate the upper support rod, the limiting sleeve 1*d* is pressed down, so that the first tooth portion 11 on the limiting sleeve 1*d* is separated from the second tooth portion 12 on the lower bearing seat 1*b*, and the upper support rod 8*a* can be rotated. The upper support rod 8*a* can drive the upper bearing seat 1*a* to rotate relative to the lower bearing seat 1*b*.

The invention claimed is:

1. A rotation mechanism for an umbrella, comprising:

a hollow vertical column having a through hole;

a rotating shaft having a peripheral wall for a rope to wrap onto, rotatably disposed inside the through hole of the column;

a ratchet sleeved around the rotating shaft;

a magnet block; and a pressing assembly;

wherein, the ratchet has two side surfaces and a plurality of ratchet teeth on a periphery of the ratchet;

the column has a limiting room opening towards the ratchet teeth for receiving the magnet block;

the magnet block is movably located inside the limiting room, and has a magnetic attraction surface capable of being attached to the ratchet teeth;

when the rotating shaft rotates in a first direction, the magnet block separates from the ratchet teeth;

when the rotating shaft rotates in a second direction, the magnet block is attached and magnetically attracted to the ratchet teeth, so as to limit the rotation of the ratchet in the second direction;

the pressing assembly is connected to the rotating shaft and presses against the two side surfaces of the ratchet, so as to allow the ratchet to rotate with the rotating shaft when the rotating shaft rotates in the first direction, and the magnet block stops the ratchet from rotating when the rotating shaft rotates in the second direction.

2. The rotation mechanism of claim 1, wherein the magnet block is placed between a wall of the limiting room and the ratchet teeth of the ratchet.

3. The rotation mechanism of claim 1, wherein the rotating shaft has a first end and a second end, both ends extending out of the column;

the rotating mechanism further comprises a handle for rotating the rotating shaft, the handle is disposed outside of the column and connected to the first end of the rotating shaft; and the ratchet and the pressing assembly are disposed on the second end of the rotating shaft.

4. The rotation mechanism of claim 3, wherein the second end of the rotating shaft has an external thread on the second end of the rotating shaft, and has an opening extending axially from the second end of the rotating shaft and running straight through a periphery of the rotating shaft to form a slot;

the pressing assembly comprises a nut, a first gasket and a second gasket, the first gasket and the second gasket are sleeved around the second end of the rotating shaft and respectively disposed opposite to two end faces of the ratchet;

a first transverse rod and a second transverse rod both capable of being inserted into the opening of the rotating shaft are respectively disposed on the first gasket and the second gasket; and the nut adjacent to the second end of the rotating shaft is threaded onto the rotating shaft, so that the ratchet is pressed between the first gasket and the second gasket.

5. The rotation mechanism of claim 3, wherein the columnar column is an upper bearing seat, and the rotating shaft is disposed in an upper portion of the upper bearing seat;

the rotating mechanism further comprises a lower bearing seat rotatably sleeved around a lower portion of the upper bearing seat, a bearing restrained between the upper bearing seat and lower bearing seat, and a limiting sleeve sleeved around the lower bearing seat and capable of moving up and down due to an external force;

an inner circumferential wall of the limiting sleeve and a peripheral wall of the lower bearing seat are meshed with each other through a first tooth portion and a second tooth portion that are disposed circumferentially, and the first tooth portion and the second tooth portion are separated from each other after the limiting sleeve moves down; and the limiting sleeve is partially sleeved around the upper bearing sleeve, two perforations for allowing the two ends of the rotating shaft to extend out are disposed on the wall of the limiting sleeve, and the perforations extend in an up-down direction.

6. The rotation mechanism of claim 5, further comprising a spring sleeved around the upper portion of the upper bearing seat and located between the outer circumferential wall of the upper bearing seat and the inner circumferential wall of the limiting sleeve;

a step surface capable of being supported onto the upper end face of the spring is disposed on the inner circumferential wall of the limiting sleeve, and the spring urges the limiting sleeve upwards.

7. The rotation mechanism of claim 5, further comprising a housing covering the upper bearing seat and the lower bearing seat, the handle is located outside the housing, and the upper portion of the limiting sleeve is exposed above the housing.

8. An umbrella, comprising the rotation mechanism of claim 5, wherein an upper support rod and a lower support rod are disposed vertically, the bottom of the upper support rod is inserted into the upper bearing seat from the top down and connected to the upper bearing seat, and the lower support rod is inserted with the lower bearing seat.

9. The umbrella of claim 8, wherein the lower portion of the lower bearing seat is a cylindrical body and has an outer diameter gradually tapering from the top down;

the umbrella further comprises a connecting bushing sleeved around the cylindrical body, the inner diameter of the connecting bushing gradually tapers from the top down and is matched with the outer diameter of the cylindrical body; and the upper portion of the lower support rod is sleeved around the connecting bushing.

10. The umbrella of claim 9, further comprising a spring piece and a buckle;

the spring piece is in an inverted V-shape, and one end of the spring piece rests against the inner circumferential wall of the cylindrical body, and the other end thereof is connected to the buckle; and a plurality of holes for allowing the buckle to pass therethrough are disposed on the circumferential walls of the cylindrical body, the connecting bushing and the lower support rod.

* * * * *